United States Patent [19]

Allemann

[11] Patent Number: 4,860,954

[45] Date of Patent: Aug. 29, 1989

[54] ADJUSTABLE OSCILLATING WAVE-TYPE SPRINKLER

[75] Inventor: James G. Allemann, Orange, Calif.

[73] Assignee: Rain Bird Consumer Products MFG. Corp., Glendora, Calif.

[21] Appl. No.: 40,059

[22] Filed: Apr. 20, 1987

[51] Int. Cl.[4] ..... B05B 1/08; B05B 3/16

[52] U.S. Cl. ..... 239/101; 239/242; 239/263; 239/263.3; 239/381

[58] Field of Search ..... 239/101, 242, 263, 263.3, 239/380, 381

[56] References Cited

U.S. PATENT DOCUMENTS

| | | | |
|---|---|---|---|
| 1,999,804 | 4/1935 | De Loria | 239/381 X |
| 2,546,241 | 3/1951 | Squiers | 239/242 |
| 2,566,856 | 9/1951 | Rose | 239/101 X |
| 2,597,366 | 5/1952 | Nordenstam . | |
| 2,914,255 | 11/1959 | Jepson . | |
| 2,942,789 | 6/1960 | Smith . | |
| 2,962,220 | 11/1960 | Woods | 239/263 X |
| 3,261,553 | 8/1966 | Kooi et al. . | |
| 3,578,248 | 5/1971 | Congdon et al. . | |
| 3,630,450 | 12/1971 | Stephany et al. . | |
| 3,630,451 | 12/1971 | Farmer . | |
| 3,767,118 | 10/1973 | Oberto et al. . | |
| 3,788,551 | 1/1974 | Standal . | |
| 3,829,018 | 8/1974 | Oberto . | |
| 3,915,383 | 10/1975 | King . | |
| 4,069,976 | 1/1978 | Chauvigne . | |
| 4,140,278 | 2/1979 | Troup . | |
| 4,220,284 | 9/1980 | Beiswenger et al. . | |
| 4,757,946 | 7/1988 | Johnson | 239/99 |

*Primary Examiner*—Andres Kashnikow
*Assistant Examiner*—Patrick H. Burkhart
*Attorney, Agent, or Firm*—Kelly, Bauersfeld & Lowry

[57] ABSTRACT

An oscillating wave-type sprinkler having a housing supporting an elongated spray tube which is driven by a water motor to oscillate from side-to-side about a generally horizontal axis. A throttling mechanism is provided to cyclicly throttle the water flow to the spray tube to improve distribution and enhance the aesthetic appearance of the wave-shaped spray, and the spray tube is mounted to the housing by end fittings which eliminate thrust loading on the tube.

22 Claims, 2 Drawing Sheets

FIG. 1
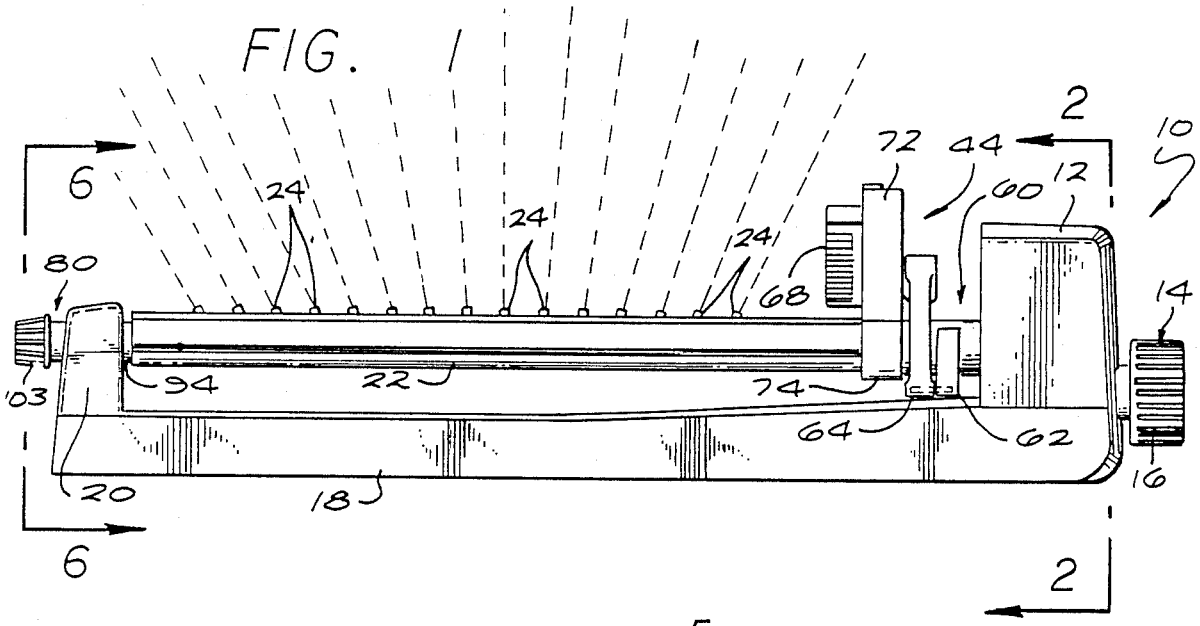
FIG. 2
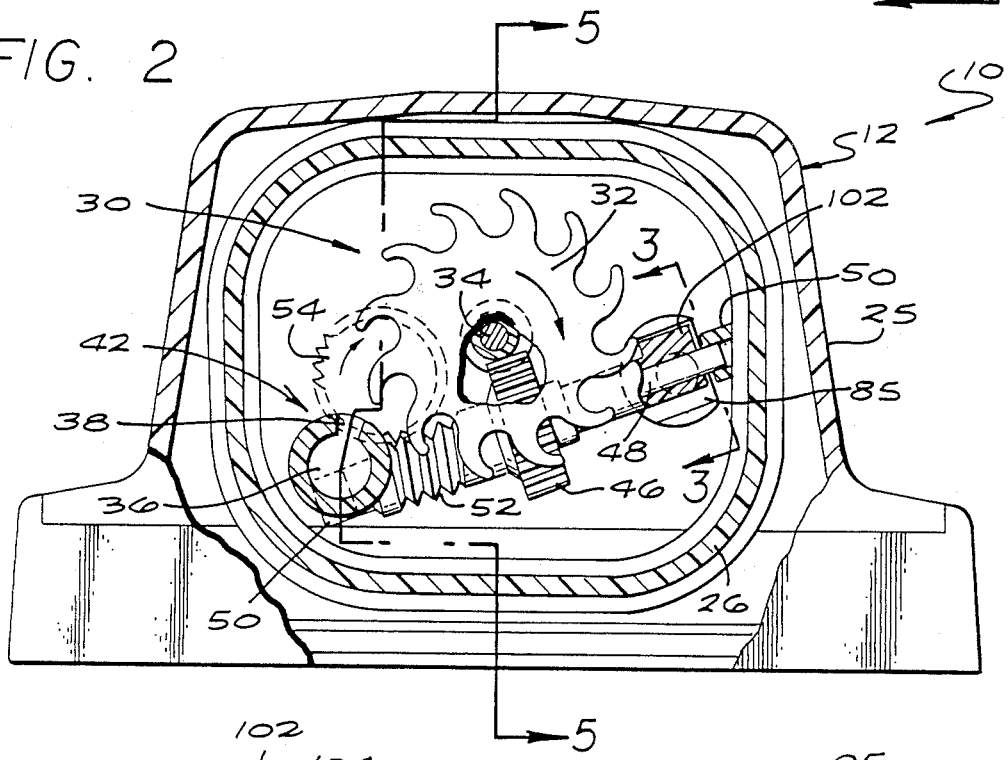
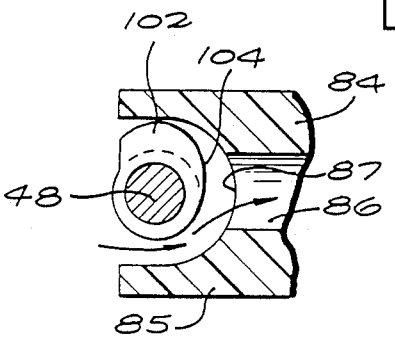
FIG. 3
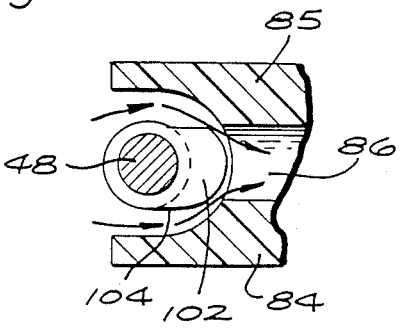
FIG. 4

FIG. 5
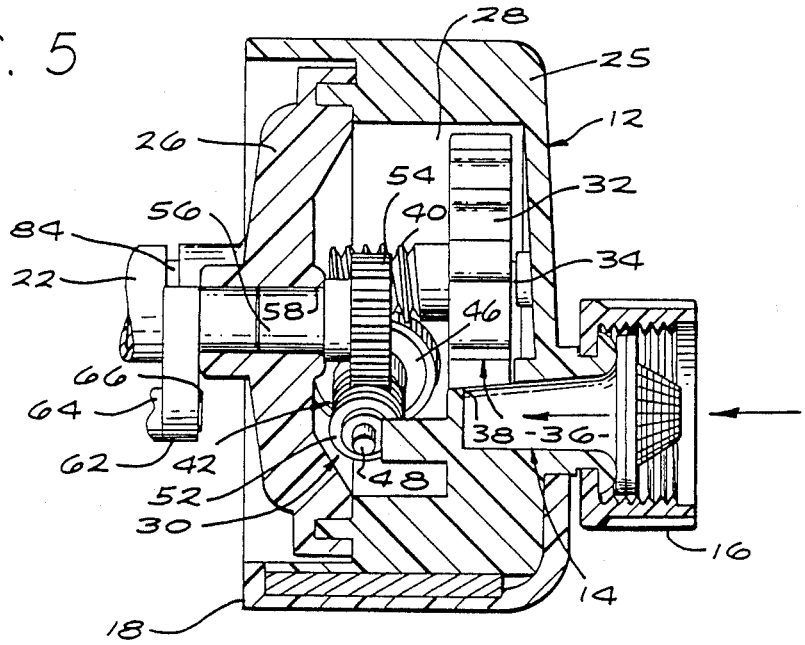
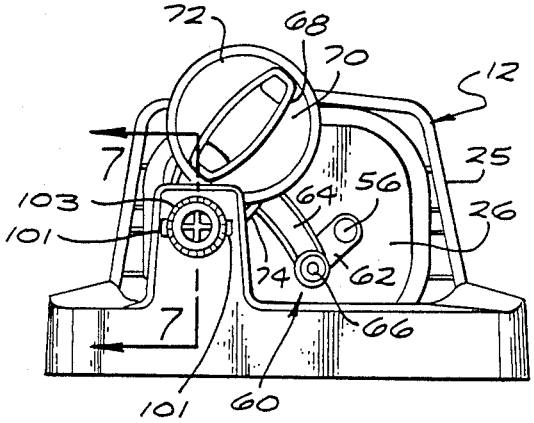
FIG. 6
FIG. 7
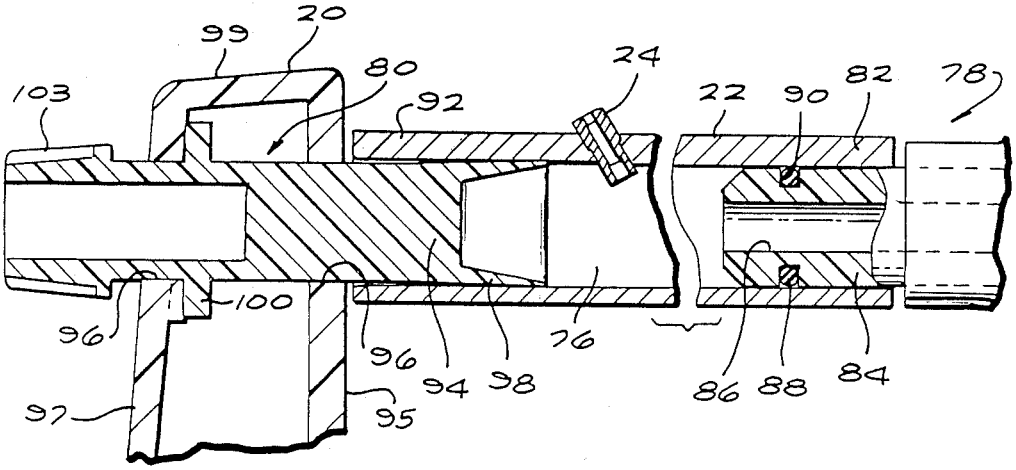

ADJUSTABLE OSCILLATING WAVE-TYPE SPRINKLER

BACKGROUND OF THE INVENTION

This invention relates to irrigation sprinklers, and more particularly to a new and improved oscillating wave-type sprinkler primarily intended for use in irrigating lawns, flowers, shrubs and the like.

Oscillating wave-type sprinklers have long been known and used in the irrigation art for watering lawns, gardens, shrubs, flowers and other plants. Typically, such sprinklers include a water-driven motor mounted in a housing and which drives an elongated spray tube for side-to-side oscillation about a generally horizontal axis. The spray tube, which usually is formed of thin-gauge tubular metal and is bowed along its length, has a plurality of water outlet openings or nozzles spaced along the length of the tube and which project discrete water streams outwardly from the tube in a fan-like spray pattern. As the spray tube oscillates about its axis, the fan-like spray produced by the outlets or nozzles translates back and forth across the ground producing a gentle rain-like fallout to either side of the sprinkler. Exemplary of such prior art oscillating wave-type sprinklers are those marketed by Rain Bird Sprinkler Mfg. Corp. of Glendora, Calif., as, for example, depicted at page 7 of their 1987 Rain Bird Consumer Products catalogue.

One disadvantage inherent in most oscillating wave-type sprinklers is that the distribution pattern of water over the ground tends to be confined to discrete narrow strips or bands formed on each side of the spray tube where the individual water sprays from each outlet or nozzle regularly fall to the ground. As a result, oscillating wave-type sprinklers typically produced water distribution patterns that leave unwatered or underwatered strips between the watered strips produced by the fallout from each spray tube outlet or nozzle.

Thus, there exists a need for an oscillating wave-type sprinkler which overcomes the foregoing disadvantage and provides a substantially uniform water distribution pattern that does not leave unwatered or underwatered strips along the length of the fan-shaped spray as the spray tube oscillates from side to side. As will become more apparent hereinafter, the present invention satisfies this need and provides additional advantages and features not found in the prior art.

SUMMARY OF THE INVENTION

The present invention provides an oscillating wave-type sprinkler having means for cyclicly throttling the flow of water admitted to the sprinkler spray tube so as to enhance the water distribution pattern of the fan-shaped spray and provide an enhanced aesthetic appearance to the spray pattern during operation. More specifically, the present invention provides an oscillating wave sprinkler having a housing within which is mounted a water driven motor, and which supports a spray tube for side-to-side oscillation about a generally horizontal axis to produce an oscillating fan-shaped spray. Throttling means are disposed within the housing and coupled with the water-driven motor to periodically and cyclicly restrict the flow of water to the spray tube, thereby producing a cyclical reduction in the distance water is sprayed from each outlet or nozzle along the length of the spray tube. As a result, the fan-shaped spray is constantly cycled during oscillation of the spray tube to produce an undulating spray pattern condition which ensures the irrigation of all areas between each outlet or nozzle along the length of the spray tube.

In accordance with another aspect of the present invention, means are provided for mounting the spray tube in such a manner as to substantially prevent thrust loading on the spray tube during operation. Toward this end, the spray tube is formed to have open ends and is mounted for oscillation to the housing by end plugs which project into the open ends of the spray tube to transmit any thrust loading within the spray tube to the upstanding arbor of the sprinkler ground support legs. With this construction, less torque is necessary for driving the spray tube, thereby permitting use of a smaller gear train for the waterdriven motor and prolonging life of the sprinkler.

Many other features and advantages of the present invention will become apparent from the following description taken in conjunction with the accompanying drawings which disclose, by way of example, the principles of the invention.

BRIEF DESCRIPTION OF THE DRAWINGS

FIG. 1 is a side elevational view of an oscillating wave-type sprinkler embodying the principles of the present invention;

FIG. 2 is an enlarged perspective view, partially in cut-away cross-section and taken substantially along the line 2—2 of FIG. 1;

FIG. 3 is an enlarged fragmentary sectional view taken substantially along the line 3—3 of FIG. 2;

FIG. 4 is an enlarged fragmentary sectional view similar to FIG. 3 but showing a throttling cam of the present invention in the throttling position;

FIG. 5 is a fragmentary cross-sectional view taken substantially along the line 5—5 of FIG. 2;

FIG. 6 is an end elevational view as seen in the direction of line 6—6 of FIG. 1; and FIG. 7 is a fragmentary sectional view with portions of the spray tube omitted for compact illustration, and taken substantially along lines 7—7 of FIG. 6.

DETAILED DESCRIPTION

As shown in the exemplary drawings, the present invention is embodied in a new and improved adjustable oscillating wave-type sprinkler 10 primarily intended for use in irrigating lawns, flowers, shrubs, and the like. In this instance, as shown in FIG. 1 of the drawings, the sprinkler 10 comprises a motor housing 12 having a water inlet 14 attachable, herein by a coupling 16, to a garden hose (not shown) or other source of pressurized water, and a pair of laterally spaced and forwardly extending ground support legs 18 terminating in an upstanding arbor 20. Disposed between the motor housing 12 and the arbor 20 is a horizontally extending elongated spray tube 22 having a plurality of spray nozzles 24 spaced therealong for ejecting water streams outwardly from the sprinkler 10 into the atmosphere. In this instance, the spray tube 22 is generally straight between the arbor 20 and motor housing 12, and the nozzles are inset into the spray tube at an angle so as to produce a fan-shaped spray, as indicated by the dash lines of FIG. 1. As will become more apparent hereinafter, the spray tube 22 could equally be bowed along its length and the nozzles can be replaced by apertures through the spray tube located to project a fan-type water spray, as is conventional in oscillating wave-type sprinklers known in the art.

Disposed within the motor housing 12 which, as best can be seen in FIG. 5, includes a rear housing section 25 secured to a forward housing section 26 and defining an internal watertight cavity 28 therebetween, is a water driven motor 30 of generally conventional design, and which operates to drive the spray tube 22 in an oscillating manner for side-to-side rotation about its longitudinal axis. As seen in FIGS. 2 and 5, the motor 30 herein includes a water driven impeller 32 supported for rotation on an impeller shaft 34 horizontally journaled between the rear and forward housing sections 25 and 26, respectively, and positioned to intercept water entering the housing 12 through the inlet 14 which herein includes an inlet passageway 36 extending horizontally from the coupling nut !6 through the rear housing section 25 and an outlet opening 38 for directing incoming water upwardly toward the periphery of the impeller 32 for effecting rotation thereof.

Integrally formed with the impeller 32 and projecting forwardly about the impeller shaft 34 is a drive gear, herein a worm 40 which rotates with the impeller to drive a speed reducing gear train 42 coupled through an arc adjusting assembly 44 to rotate the spray tube 22 about its longitudinal axis. Herein, the speed reducing gear train 42 includes a worm gear 46 mounted for rotation on an inclined support shaft 48 disposed within the chamber 30 and herein journaled at opposed ends in inwardly projecting bosses 50 formed integrally with the rear housing section 25. Integrally formed with and projecting along the support shaft 48 on one side of the worm gear 46, is a second worm 52 drivingly engaged with a second worm gear 54 coaxially attached to an output shaft 56 journaled within a cylindrical bore 58 formed through the wall of the forward housing section 26.

In operation, water entering the inlet 14 is directed onto the impeller 32 causing the impeller to rotate the worm 40 and drive the worm gear 46 about the impeller shaft 34. Rotation of the worm gear 46 and the attached second worm 52 rotates the second worm gear 54 and output shaft 56 which is coupled by a crank arm assembly 60 to the arc adjustment assembly 44 and spray tube 22. In a presently preferred embodiment of the present invention, the gear ratio between the impeller 32 and its worm 40, and the worm gear 46 driven thereby is selected to be 24 to 1 and the gear ratio between the worm gear 46 and its associated second worm 52 and the output worm gear 54 is also selected to be 24 to 1, thereby resulting in a 576 to 1 reduction effected by the gear train 42 between the impeller 32 and the output shaft 56.

The crank arm assembly 60 is of generally conventional design and includes a crank 62 attached at one end to the output shaft 56 outwardly of the motor housing 12, and at the opposite end, pivotally attached to a connecting arm 64 by a link pin 66. The connecting arm 64 is coupled to the arc adjustment assembly 44 which herein includes a selector dial or knob 68 attached to a disk 70 releasably coupled within an annular housing 72 having a peripheral projection 74 surrounding and non-rotatably coupled to the spray tube 22. The connecting arm 64 is attached adjacent the periphery of the disk 70 by a pivot pin (not shown) and the disk 70 can be selectively rotated by the knob 68 relative to the annular housing 72. By selection of the rotary position of the knob 68 and disk 70 relative to the annular housing 72, the arc of oscillation of the arc adjustment assembly 44, and hence the spray tube 22, can be controlled such that each 360 degree rotation of the output shaft 56 and crank 62 is translated to rotation of the spray tube 22 about its longitudinal axis between 0 degrees and 45 degrees to each side of the center position illustrated in FIG. 1, as is known in the art.

In accordance with one aspect of the present invention, the spray tube 22 is constructed and mounted between the motor housing 12 and arbor 20 in such a manner as to minimize thrust loading on the tube, thereby to reduce the drive torque necessary to rotate the tube, while providing enhanced effectiveness and reliability in use and at a reduced cost. Toward these ends, the spray tube 22 is formed as an open-ended cylindrical tube having a central water passage 76 formed therethrough, and is supported between the motor housing 12 and the arbor 20 by, respectively, a housing end fitting 78 and an arbor end fitting 80 which absorb axial thrust loads developed during use so that the spray tube is subject to only radial forces.

As best can be seen in FIG. 7, an inlet end portion 82 of the spray tube 22 is rotatably coupled to the housing end fitting 78 which is formed by a cylindrical nipple 84 projecting outwardly from the wall of the forward housing section 26 and which extends coaxially into the inlet end portion of the tube. The nipple 84 has an interior water passageway 86 which defines an outlet conduit from the motor housing 12 and through which water passes from the housing cavity 28 to the spray tube water passage 76. Preferably, the nipple 84 is formed integrally with the forward housing section 26 and includes a tubular inner portion 85 forming an inlet 87 to the passageway 86 outlet from the housing cavity 28. To provide a water tight seal between the inlet end portion 82 of the spray tube 22 and the nipple 84, an o-ring seal 88 is disposed in an annular groove 90 formed around the outer peripheral surface of the nipple. With this construction, all axial forces in the direction of the motor housing 12 generated by pressurized water within the water passage 76 of the spray tube 22 will react against the nipple 84 and forward housing section 26, and be absorbed thereby, thus eliminating any thrust loading on the inlet end portion 82 of the spray tube which typically is formed of relatively thin gauge metal such as aluminum.

Similarly, the terminal end portion 92 of the spray tube 22 is rotatably mounted to the arbor 20, which herein is formed integrally with the support legs 18 and has inner and outer spaced walls 95 and 97, respectively, closed by a top wall 99, by the arbor end fitting 80 such that thrust loading created by pressurized water within the water passage 76 will be absorbed by the end fitting and the arbor 20, rather than by the terminal end portion of the spray tube. In this instance, the arbor end fitting 80 is formed by a generally cylindrical end plug 94 supported in cylindrical openings 96 formed through the inner and outer walls 95 and 97 of the arbor 20, and projects into the terminal end portion 92 of the spray tube. The inner end of the plug 94 terminates in a pressure activated lip seal 98 which is pressed into water tight sealing engagement with the spray tube 22 upon the introduction of pressurized water into the water passage 76 and which permits the spray tube to rotate relative to the end fitting and arbor 20. To transmit axial thrust loading on the end plug to the arbor, a pair of radially projecting rectangular-shaped ears 100 are formed on the plug and which abut the face of the outer wall 97 of the arbor in the area around its cylindrical opening 96. To facilitate assembly and disassembly, the cylindrical opening 95 in the outer wall 97 includes a pair of slots 101 which permit the ears 100 to be passed therethrough. This allows the arbor end plug 94 to be readily inserted or removed from the arbor 20 by aligning the ears 100 with the slots 101, and to be locked to the arbor by rotating the plug to disalign the ears with the slots, a knob 103 being provided on the outer end of the plug for this purpose.

With this structure, axial forces generated during use within the water passage 76 of the spray tube 22 in the direction of the arbor 20 will be transmitted to the arbor by the ears 100 of the end plug 94 so that no axial loading is experienced by the spray tube. By reducing the thrust loading on the spray tube 22, the present invention allows a lower torque drive motor 30 and small gear train 42 to be used, and prolongs the life of the sprinkler 10. Further, should it be necessary to disassemble the spray tube 22 from the sprinkler 10, such as for cleaning a clogged nozzle 24, all that needs to be done is to rotate the end plug 94 to align the ears 100 with the slots 101 and withdraw the plug through the cylindrical openings 96.

In accordance with another and principal feature of the present invention, means are provided within the cavity 28 of the motor housing 12 to periodically and cyclicly throttle the flow of water to the spray tube 22 for substantially enhancing the water distribution pattern of the fan-shaped spray from the sprinkler 10, and for providing an enhanced aesthetic appearance to the spray pattern. Toward these ends, as best seen in FIGS. 2 through 4, a throttling cam 102 is mounted on the support shaft 48 adjacent the mounting boss 50 on the side of the worm gear 46 opposite that of the second worm 52, and is disposed adjacent the inlet 87 to the passageway 86 through the nipple 84.

Rotation of the worm gear 46 by the impeller 32 causes the cam 102 to rotate past the inlet opening 87 to the nipple passageway 86 and partially block or throttle that opening to the flow of water from the cavity 28. In one presently preferred embodiment, the cam 102 is a single lobe cam having a curved leading edge 104 which functions to gradually throttle the flow of water from the cavity 28 to the passageway 86 as the cam is rotated past the inlet opening in a clockwise direction as viewed in FIGS. 3 and 4. As a result of throttling the flow of water from the cavity 28 to the water passage 76 of the spray tube 22, the distance water is ejected from the spray nozzles 24 will significantly decrease, thereby producing a gradually decreasing and somewhat tightened fan-shaped spray pattern. Thus, each individual water stream emitted from the nozzles 24 of the spray tube 22 will be pulled axially inwardly relative to the center of the spray tube between its inlet and terminal ends, thereby enhancing the water distribution pattern of the sprinkler 10.

In the presently preferred embodiment of the subject invention, since the throttling cam 102 is mounted for rotation together with the worm gear 46, the throttling cam will rotate past the inlet opening 87 to the water passageway 86, 24 times for each oscillation of the spray tube 22 about its longitudinal axis. This then produces a constantly varying and undulating fan shaped spray which not only enhances distribution, but also is dynamic and pleasing to watch as the fan-shaped spray regularly increases and decreases in distance during spray tube oscillation. In one working prototype of the present invention, it was found that by proper selection of the size of the cam 102 relative to the inlet opening 87 to the passageway 86, at a supply pressure of 40 psi, the spray pattern from the sprinkler 10 would have a maximum distance of throw of approximately 40 feet and, when in the fully throttled condition as depicted in FIG. 4, the maximum distance of throw was reduced by almost fifty percent to approximately 22 feet.

Thus, the throttling cam 102 effectively operates to periodically and cyclicly restrict the flow of water to the spray tube 22 thereby producing a cyclical reduction in the distance the fan-shaped spray projects outwardly from the sprinkler 10. Since the water sprays from all but the center of the nozzles 24 which project outwardly at an angle relative to the longitudinal ends of the spray tube 22, each time the throttling cam 102 throttles the flow, the strip watered by each nozzle will be pulled inwardly toward the longitudinal center of the spray tube 22 between its ends, thereby filling in and watering the entire area between each nozzle. Consequently, the throttling means produces a spray pattern that substantially enhances the overall distribution of water about the sprinkler 10.

While a particular form of the invention has been illustrated and described, it will be apparent that various modifications can be made without departing from the spirit and scope of the invention.

I claim:

1. An oscillating wave sprinkler of the type primarily intended for use in irrigating lawns, flowers, shrubs and the like comprising:

a housing having an internal watertight cavity formed therein;

means for coupling said housing to a source of pressurized water and for directing water from said source into said cavity;

support base means projecting forwardly from said housing and terminating in an upstanding arbor;

an elongated, generally hollow spray tube extending between said housing and said arbor and disposed for rotary oscillating about a generally horizontal axis;

means coupling one end of said spray tube to said housing and having a water passageway with an inlet disposed within said cavity for conveying water from said cavity to said spray tube;

means coupling the other end of said spray tube to said arbor;

motor means coupled with said housing and said spray tube for oscillating said spray tube about said axis; and throttling means disposed adjacent said inlet for periodically throttling the flow of water from said cavity to said spray tube to produce a cyclical reduction in the distance the water projects outwardly from said spray tube during oscillation of said spray tube.

2. An oscillating wave sprinkler as set forth in claim 1 wherein said motor means includes a water-driven rotary impeller disposed within said cavity and a reducing gear train coupled to said spray tube and driven by said impeller.

3. An oscillating wave sprinkler as st forth in claim 2 wherein said throttling means is driven by said impeller.

4. An oscillating wave sprinkler as set forth in claim 3 wherein said throttling means further includes a cam coupled for rotation by said gear train and disposed to rotate past said inlet to cyclicly restrict the flow of water from said cavity to said water passageway in response to rotation of said impeller.

5. An oscillating wave sprinkler as set forth in claim 1 wherein said spray tube is an open ended cylindrical tube and said means coupling said spray tube to said housing includes a nipple projecting from said housing into said open end of said spray tube and forming a watertight seal therebetween, said spray tube being rotatable about said nipple.

6. An oscillating wave sprinkler as set forth in claim 5 wherein said means coupling said other end of said spray tube to said arbor includes a plug mounted to said arbor and projecting into said other end of said spray tube and forming a watertight seal therewith, said spray tube being rotatable relative to said plug.

7. An oscillating wave sprinkler as set forth in claim 6 where said plug is removable from said arbor and said other end of said spray tube for permitting disassembly of said spray tube from said sprinkler.

8. An oscillating wave sprinkler of the type primarily intended for use in irrigating lawns, flowers, shrubs and the like comprising:

a housing having an internal watertight cavity formed therein;

means for coupling said housing to a source of pressurized water and for directing water into said cavity;

support base means projecting forwardly from said housing and terminating in an upstanding arbor;

an elongated, open-ended cylindrical spray tube extending between said housing and said arbor and disposed for rotary oscillation about a generally horizontal axis;

a nipple projecting from said housing into one end of said spray tube for coupling said spray tube to said housing, said nipple having a water passageway therethrough with an inlet disposed within said cavity for conveying water from said cavity to said spray tube;

a plug mounted to said arbor and projecting into the other end of said spray tube for coupling said spray tube to said arbor;

a water-driven impeller mounted for rotation within said cavity;

a reducing gear train coupled with said impeller and with said spray tube, and driven by said impeller to oscillate said spray tube about said axis; and a rotary throttling cam disposed within said cavity adjacent said inlet to said passageway through said nipple, said cam being drivingly coupled to said impeller to periodically rotate past said inlet at least once during each oscillation of said spray tube about said axis thereby to cyclically restrict the flow of water from said cavity to said spray tube in response to rotation of said impeller.

9. An oscillating wave sprinkler as defined in claim 8 wherein said reducing gear train is coupled to said spray tube through an arc selector assembly means adjustable to select the arc of oscillation of said spray tube about said axis.

10. An oscillating wave sprinkler as set forth in claim 8 wherein said plug is removably mounted to said arbor and said other end of said spray tube for permitting disassembly of said spray tube from said sprinkler.

11. In an oscillating wave sprinkler of the type primarily intended for irrigating lawns, flowers, shrubs and the like and including a housing supporting an elongated spray tube disposed for side-to-side oscillation about a generally horizontal axis and having a water inlet through which water from a pressurized source is admitted and a plurality of water outlets spaced along the tube from which water streams are ejected in a fan-shaped spray pattern, and a motor for oscillating the spray tube, the improvement comprising:

means coupled to said housing for periodically and cyclically throttling the flow of water from said source to said spray tube inlet at least once during each oscillation of said spray tube about said generally horizontal axis.

12. The improvement as set forth in claim 11 wherein said means comprises a cam disposed adjacent said inlet and rotatable by said motor to cyclicly restrict the passage of water into said inlet.

13. The improvement as defined in claim 11 further including means for supporting said spray tube at said housing to substantially prevent thrust loading on said tube during oscillation thereof.

14. The improvement as defined in claim 13 wherein said spray tube has open ends and said means for supporting said spray tube include end fittings attached to said housing and projecting into said open ends, said tube being rotatable relative to said end fittings.

15. The improvement as defined in claim 11 wherein said means comprises a rotary cam disposed adjacent said inlet and drivingly coupled to said motor for cyclicly restricting the passage of water into said inlet, and further including end fitting means for supporting said spray tube to said housing to substantially prevent thrust loading on said spray tube during oscillation thereof.

16. An oscillating wave sprinkler as set forth in claim 1, wherein said throttling means comprises an imperforate cam having an axis of rotation transverse to said inlet.

17. An oscillating wave sprinkler as set forth in claim 16, wherein said ca has a curved edge which rotates past said inlet to gradually vary the flow of water from said cavity to said spray tube as the cam is rotated about said axis of rotation.

18. An oscillating sprinkler as set forth in claim 1, wherein said throttling means includes means producing a multiplicity of cyclical reductions in the distance of water projection for each oscillation of said spray tube about said axis.

19. An oscillating sprinkler as set forth in claim 8, wherein said cam is drivingly coupled to said impeller to periodically rotate past said inlet a multiplicity of times during each oscillation of said spray tube about said axis.

20. An oscillating sprinkler as set forth in claim 19, wherein said cam is drivingly coupled to said impeller to periodically rotate past said inlet about twenty-four times during each oscillation of said spray tube about said axis.

21. An oscillating sprinkler as set forth in claim 11, wherein said means comprises a cam disposed adjacent said inlet and rotatable by said motor to cyclically restrict the passage of water into said inlet a multiplicity of times for each oscillation of the spray tube.

22. An oscillating sprinkler as set forth in claim 21, wherein said cam is rotatable by said motor to cyclically restrict the passage of water into said inlet 24 times for each oscillation of the spray tube.

* * * * *